US006276442B1

(12) United States Patent
Rasmussen

(10) Patent No.: US 6,276,442 B1
(45) **Date of Patent: *Aug. 21, 2001**

(54) COMBINED CONDENSER/HEAT EXCHANGER

(75) Inventor: Gordon I. Rasmussen, Jackson, NJ (US)

(73) Assignee: Electric Boat Corporation, Groton, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/089,599

(22) Filed: Jun. 2, 1998

(51) Int. Cl.[7] ..... F28B 1/00

(52) U.S. Cl. ..... 165/110; 165/140; 165/114; 165/DIG. 211; 165/DIG. 213

(58) Field of Search ..... 165/140, 110, 165/114, DIG. 211, DIG. 213, 917

(56) References Cited

U.S. PATENT DOCUMENTS

| | | | | |
|---|---|---|---|---|
| 1,591,769 | * | 7/1926 | Morgan | 165/DIG. 211 X |
| 2,111,867 | * | 3/1938 | Miller et al. | 165/917 X |
| 2,340,138 | * | 1/1944 | Morris | 165/140 |
| 2,764,876 | | 10/1956 | Parcaro . | |
| 3,338,052 | | 8/1967 | Holden . | |
| 3,698,476 | | 10/1972 | Wyzalek et al. . | |
| 4,019,871 | | 4/1977 | Anderson et al. . | |
| 4,084,546 | | 4/1978 | Schneeberger et al. . | |
| 4,105,065 | * | 8/1978 | Chirico | 165/78 |
| 4,106,559 | | 8/1978 | Ritland et al. . | |
| 4,206,802 | | 6/1980 | Reed et al. . | |
| 4,300,481 | | 11/1981 | Fisk . | |
| 4,561,496 | * | 12/1985 | Kehrer | 165/103 |
| 4,576,225 | * | 3/1986 | Nassauer | 165/101 |
| 4,620,588 | | 11/1986 | Pfouts et al. . | |
| 5,509,466 | | 4/1996 | McQuade et al. . | |

FOREIGN PATENT DOCUMENTS

| | | |
|---|---|---|
| 1551168 | 9/1970 | (GB) . |
| 2085571 | 4/1982 | (GB) . |

* cited by examiner

*Primary Examiner*—Allen Flanigan
(74) *Attorney, Agent, or Firm*—BakerBotts, LLP

(57) ABSTRACT

A combined steam condenser and liquid-to-liquid heat exchanger has an outer shell forming an enclosure within which a first plurality of tubes are supported at opposite ends by tube sheets to provide a steam condenser. Within the outer shell an inner shell having a heat exchange liquid inlet and outlet contains a second plurality of tubes providing a heat exchanger. In one embodiment a first head is affixed to one end of the outer shell and cooling liquid introduced into that head passes through the second plurality of tubes and part of the first plurality of tubes to a second head at the opposite end which directs the cooling liquid through an upper portion of the first plurality back to the first head. The cooling liquid is then directed from the first head through a lower part of the first plurality of tubes toward the second head where it is discharged through an outlet. Steam received at a steam inlet in the top of the outer shell passes adjacent to the first plurality of tubes on which it is condensed and the resulting condensate falls into a condensate collection hot well having a condensate removal outlet at the bottom of the outer shell. In another embodiment U-shaped tubes are provided in both the first and second pluralities and the cooling liquid is introduced and removed from the same head at one end of the shell.

9 Claims, 14 Drawing Sheets

COMBINED CONDENSER/HEAT EXCHANGER

BACKGROUND OF THE INVENTION

This invention relates to steam surface condensers and liquid-to-liquid heat exchangers of the kind generally known as shell and tube-type heat exchangers. Typical conventional steam condensers and heat exchangers and similar devices are disclosed in U.S. Pat. Nos. 2,764,876, 3,338,052, 3,698,476, 4,084,546, 4,106,559, 4,206,802, 4,300,481 and 4,620,588.

Shell and tube-type steam surface condenser technology is well known and has been used for many applications. In such condensers, steam condenses on the outside surfaces of tubes which are kept cool by a cooling medium such as water which is circulated through the tubes. Most steam surface condensers have straight, smooth tubes of equal length that are bundled together to produce a significant volume of condensate in a relatively small volume of space.

Similarly, shell and tube-type heat exchanger technology is well known and has been used in many applications. In such heat exchangers, the warmer medium generally flows on one side of a tube and the cooler medium flows on the other side so that the warmer medium is cooled and the cooler medium is warmed. Unlike the shell and tube steam surface condenser, however, the cooling medium can flow either inside the tubes or outside of the tubes. Many shell and tube-type heat exchangers also use straight, smooth equal length tubes that are bundled together, which allows a significant quantity of heat to be transferred from the warm medium to the cool medium in a relatively small volume of space. Some shell and tube heat exchangers use U-shaped tubes and/or provide enhancements on the tubes such as fins to increase efficiency or reduce the size of the unit and/or the manufacturing costs.

SUMMARY OF THE INVENTION

Accordingly, it is an object of the present invention to provide a combined condenser/heat exchanger which overcomes the disadvantages of the prior art.

Another object of the invention is to provide a combined condenser/heat exchanger which performs the functions of a steam condenser and a liquid-to-liquid heat exchanger in a single unit having an efficient and economic structural arrangement.

These and other objects of the invention are attained by providing a plurality of steam condenser tubes and a plurality of heat exchanger tubes supported by tube sheets and having a heat exchanger tube bundle and shell disposed inside a condenser tube bundle and shell so that both the heat exchanger and the condenser sections function in the same manner as if they were separate units, but heat can be transferred from the condenser section into the heat exchanger section or vice-versa for more efficient heating or cooling of the medium involved.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
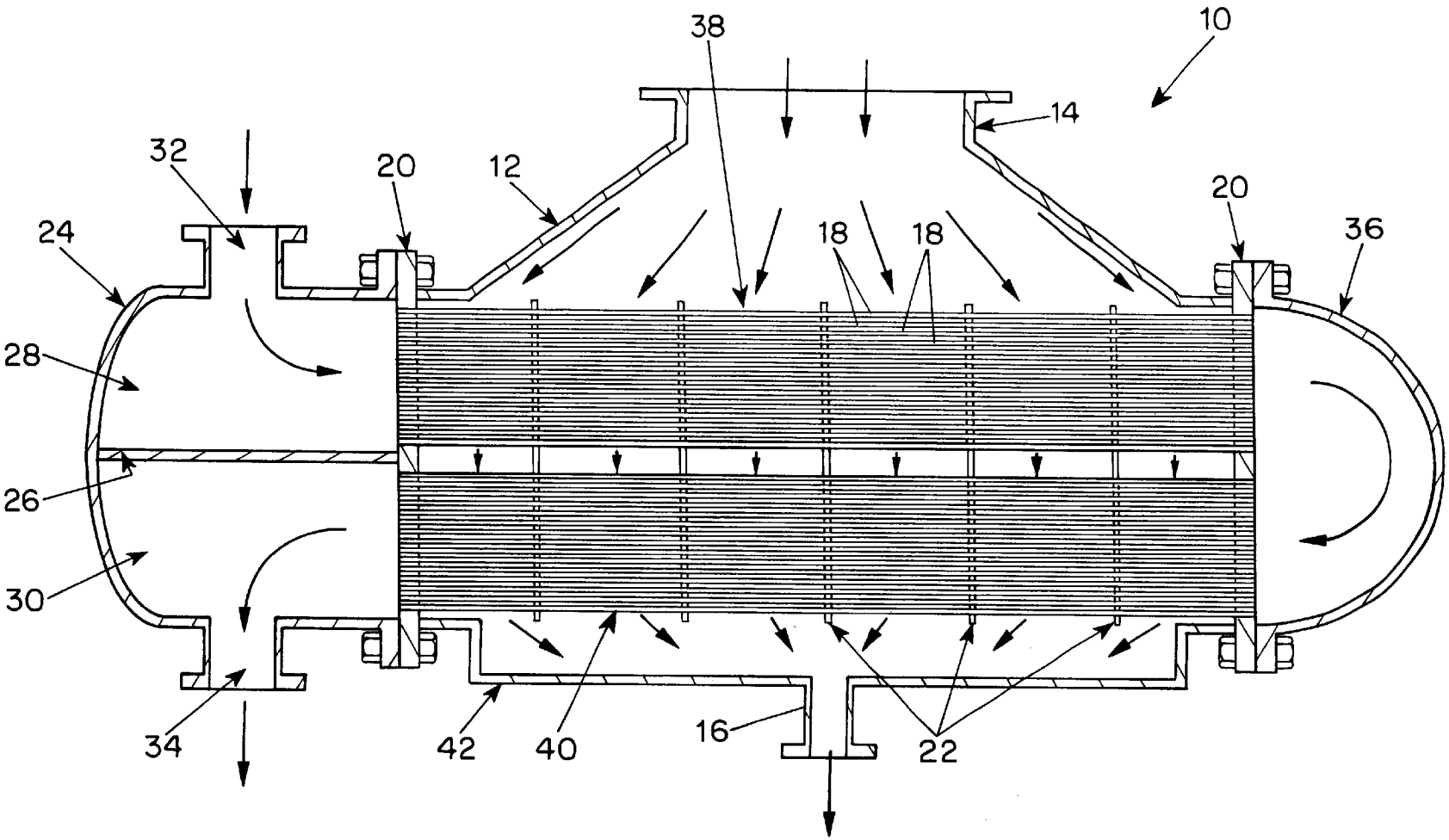
FIG. 1 PRIOR ART
FIG. 1 is a view in longitudinal section illustrating a conventional shell and tube steam surface condenser.

In the typical conventional shell and tube-type steam surface condenser 10 shown in FIG. 1, a generally cylindrical shell 12 has a large area steam inlet opening 14 at the top and a condensate outlet opening 16 at the bottom. The shell 12 encloses an array of tubes 18 supported at opposite ends by two tube sheets 20 and retained in spaced relation by tube support plates 22 which are spaced at intervals along the length of the tubes. At one end of the shell 12, an inlet-outlet head 24 affixed to the tube sheet 20, has a horizontal partition plate 26 separating the head into an upper compartment 28 and a lower compartment 30 and an opening 32 at the top of the compartment 28 is arranged to receive a cooling liquid while another opening 34 at the bottom of the lower compartment 30 provides an outlet for the cooling liquid. At the opposite end of the shell 12 a hemispherical return head 36 receives the cooling liquid after it has passed through an upper bundle 38 of the tubes 18 and directs the liquid downwardly into a lower bundle 40 of the tubes 18. Accordingly, as the cooling liquid passes through the tubes in the upper and lower banks 38 and 40, the steam which is directed from the inlet opening 14 through the spaces between the tubes 18 is cooled and condensed onto the surface of the tubes, producing liquid condensate which collects in a hot well 42 at the bottom of the shell 12 and is conveyed therein to the condensate outlet 16.

Figure 2:
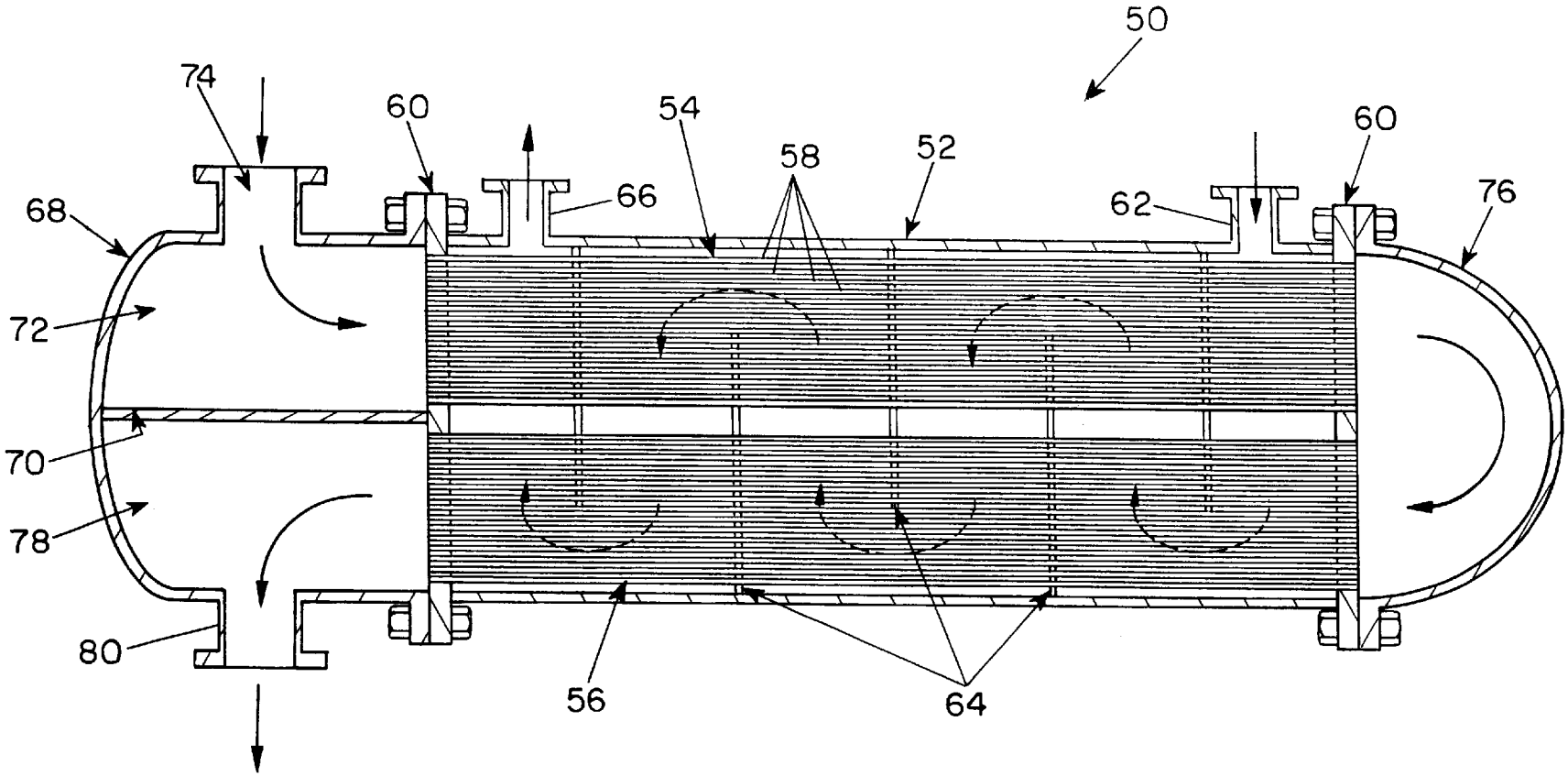
FIG. 2 PRIOR ART
FIG. 2 is a view in longitudinal section illustrating a conventional liquid-to-liquid heat exchanger.

FIG. 2 illustrates a conventional shell and tube-type heat exchanger 50 having a generally cylindrical outer shell 52 and upper and lower bundles 54 and 56 of tubes 58 supported within the shell from two tube sheets 60 mounted at opposite ends of the shell 52. A hot liquid inlet 62 at one end of the top of the shell 52 supplies a liquid to be cooled to the interior of the shell and a series of internal baffles 64, defining alternate upper and lower liquid passages, are mounted within the shell to direct the hot liquid in a sinuous path around the upper and lower tube bundles 54 and 56 path to a hot liquid outlet 66 at the opposite end of the shell.

In order to cool the hot liquid, an inlet/outlet head 68, of the same type described above with respect to FIG. 1 and having a horizontal central partition 70, is affixed to the tube sheet 60 at one end of the shell 52. Cooling liquid is supplied to an upper compartment 72 through an inlet 74 and passes through the upper bundle 54 of tubes to a return head 76 mounted on the tube sheet 60 at the opposite end of the shell. The return head directs the cooling liquid through the lower bundle 56 of tubes from which the cooling liquid passes into a lower compartment 78 in the inlet/outlet head 68 and is directed from the lower compartment 78 to a cooling liquid outlet 80.

Some conventional shell and tube heat exchangers have U-shaped tubes or apply enhancement such as fins to the tubes to reduce the size of the unit and/or manufacturing cost. In conventional shell and tube-type heat exchangers of the type described, the gap between adjacent tubes is typically about 30% to 50% of the outside diameter of the tubes.

In accordance with the invention, a combined steam condenser and heat exchanger is provided in a single structure. A typical embodiment of a condenser and heat exchanger 90 in accordance with the invention is illustrated in FIGS. 3–12. In this embodiment, a condenser shell 92 has a large area steam inlet opening 94 at the top, a hot well 96 at the bottom to receive steam condensate and a condensate outlet 98 from which the condensate may be withdrawn.

Within the shell 92, three bundles of tubes 100 are supported between two tube sheets 102 affixed to opposite ends of the condenser shell 92, i.e., an upper bundle 106, a central bundle 108, and a lower bundle 110. The central bundle 108 and the surrounding space are hydraulically separated from the upper and lower bundles by an inner heat exchanger shell 112 which is mounted in sealing relation to the tube sheets 102. A heat exchanger inlet 114, shown in FIG. 3, supplies a hot liquid to be cooled to the interior of the heat exchanger shell, and the hot liquid which has been cooled in the heat exchanger passes out through a heat exchanger outlet 1 16. Both the inlet and outlet extend from the inner heat exchanger shell to the exterior of the outer condenser shell 92.

In order to condense steam supplied through the steam inlet opening 94 and to cool the liquid supplied to the heat exchanger inlet 114, the typical embodiment shown in FIGS. 3–12 provides a three-pass cooling liquid arrangement, although more passages could be provided if desired. In this arrangement, an inlet head 120 is affixed to the tube sheet 102 at one end of the tube array and an outlet head 122 is affixed to the other tube sheet 102 at the opposite end of the array. The inlet head 120 has a cooling liquid inlet 124 and inspection windows 125. The cooling liquid inlet leads to a central generally cylindrical chamber 126 defined by a cylindrical partition plate 128 which separates the central chamber 126 from a toroidal outer chamber 130 surrounding the chamber 126. From the central cylindrical chamber 126 of the inlet head 120 cooling water received in the inlet 124 passes through all of the tubes 100 in the central circular bundle 108 contained within the heat exchanger shell 112 and also through a generally circular inner portion 134 of the tubes in the upper and lower bundles 106 and 110, thereby providing a first pass of the cooling liquid through a portion of the steam condenser tubes as well as the heat exchanger tube bundle 108.

Figure 7:
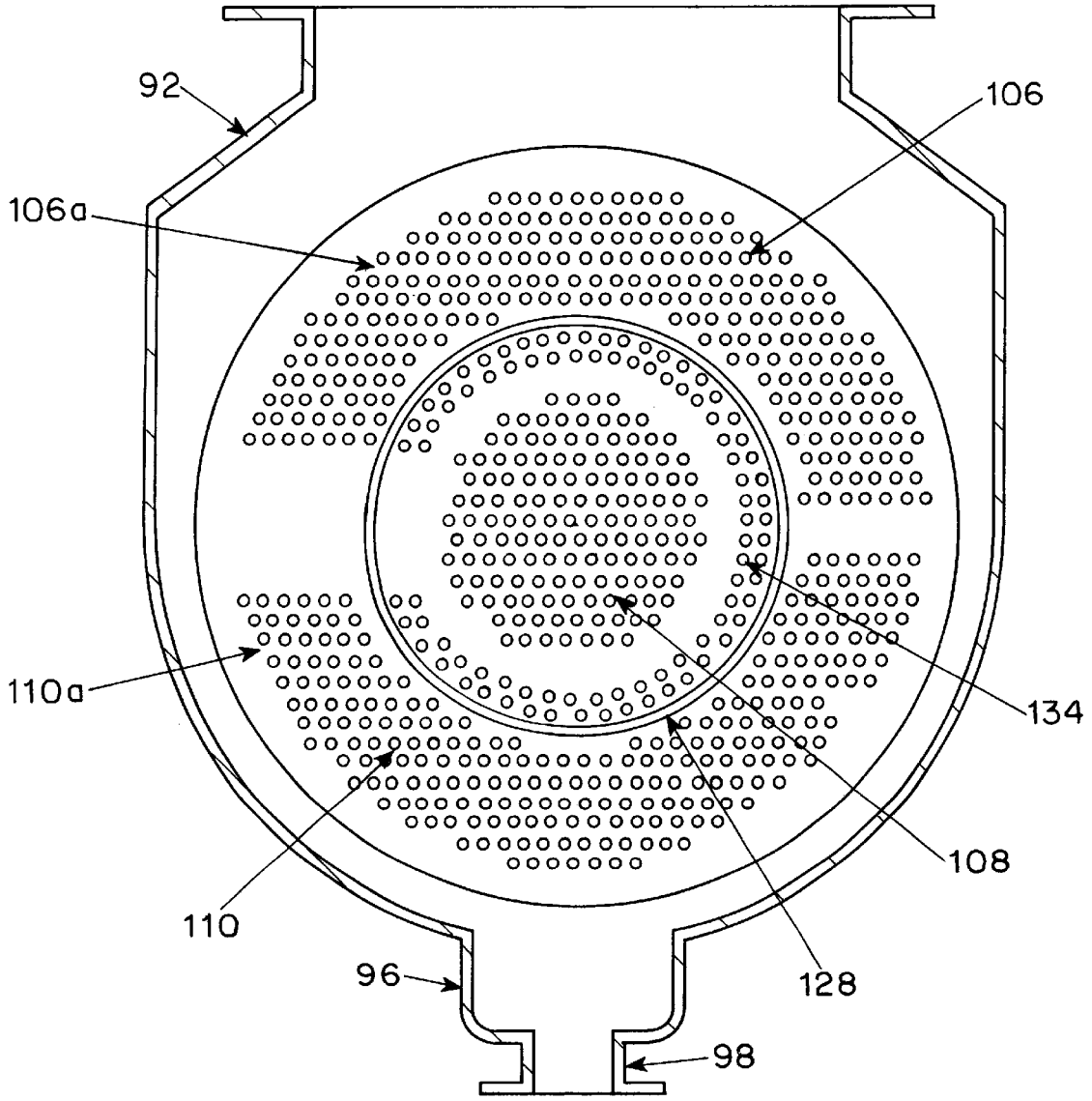
FIG. 7 is a cross-sectional view taken on the lines VII—VII of FIG. 4 and looking in the direction of the arrows.
Figure 8:
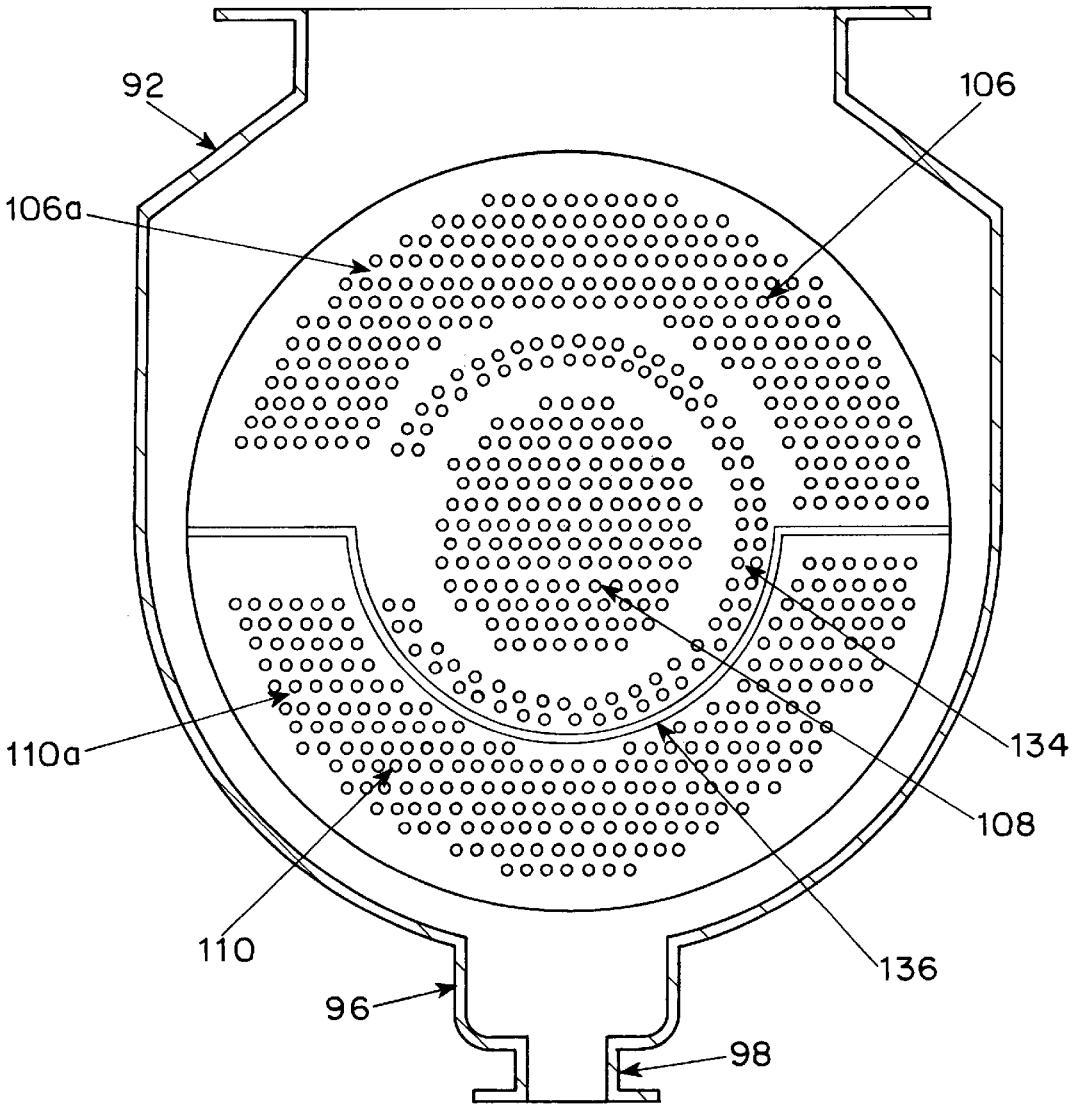
FIG. 8 is a cross-sectional view taken on the lines VIII—VIII of FIG. 4 and looking in the direction of the arrows.

In the outlet head 122 the cooling liquid is directed upwardly by a partition plate 136 which, as shown in FIG. 8, separates the outer portion 110*a* of the lower bundle of tubes 110 from the central and upper bundles 106 and 108 and the circular inner portion 134 of the lower bundle. From the outlet head 122 the cooling liquid then passes through the outer portion 106*a* of the upper bundle 106 outside the partition 128, as shown in FIG. 7, back to the inlet head 120 where the cooling liquid passes downwardly through the toroidal chamber 130 and to the lower portion 110*a* of the lower bundle of tubes 110 which are below the partition plate 136, as shown in FIG. 8, after which the cooling liquid passes into a lower chamber 140 of the outlet head 122 and into a cooling liquid outlet 142. The outlet head 122 is also provided with inspection windows 143.

Figure 3:
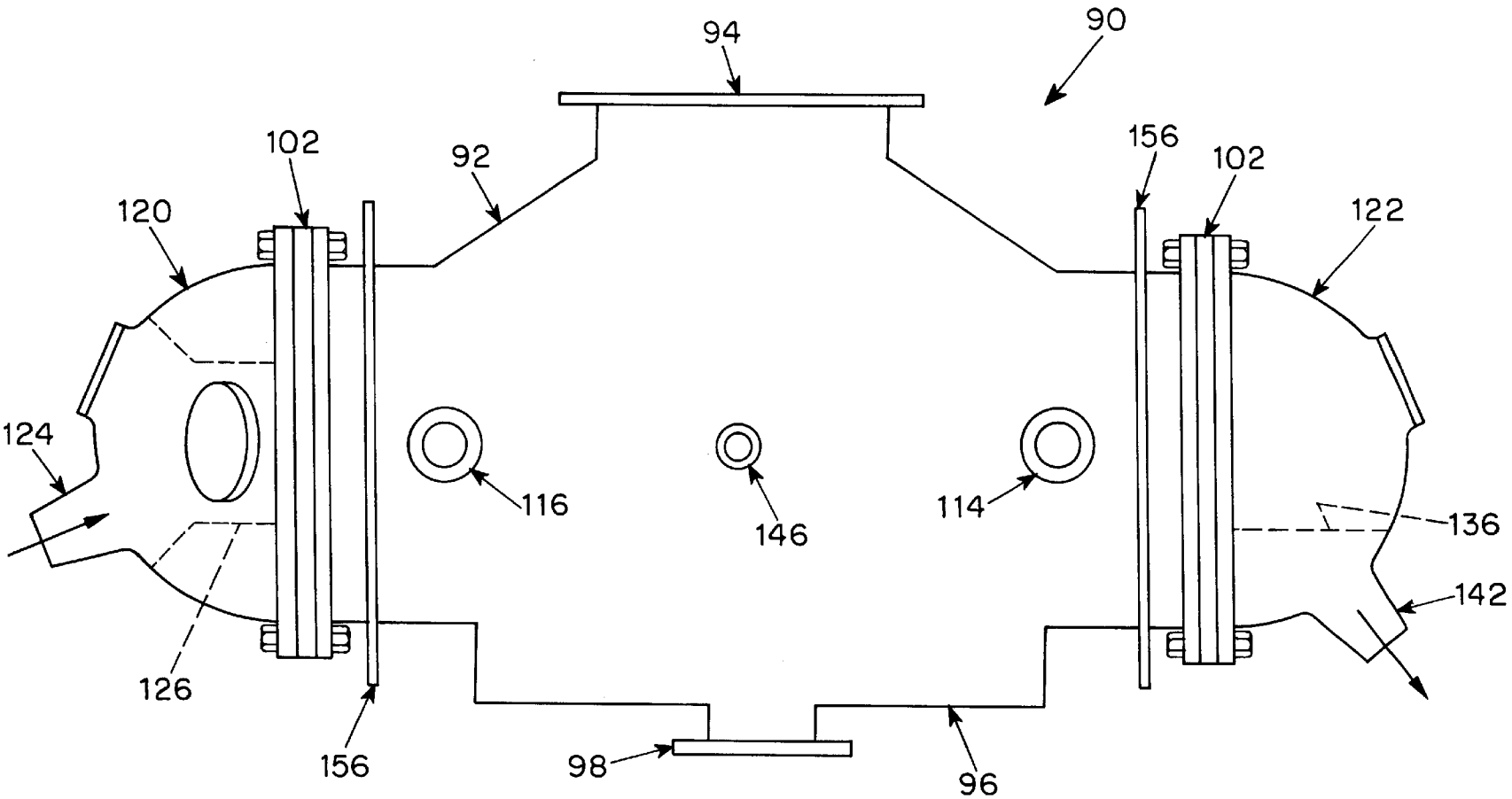
FIG. 3 is an elevation view illustrating a combined shell and tube-type steam surface condenser and liquid-to-liquid heat exchanger in accordance with the invention which provides three cooling medium passes.
Figure 4:
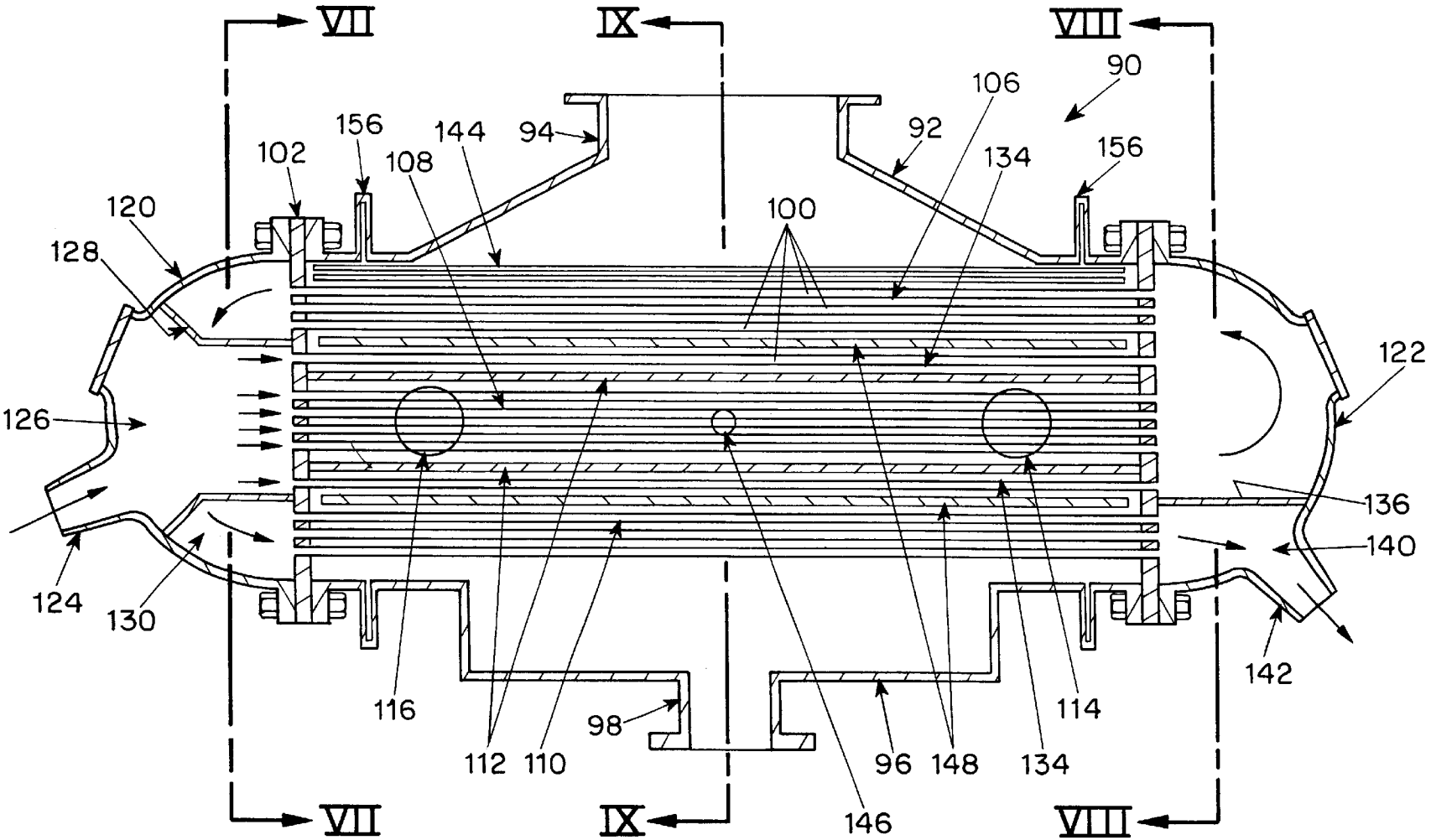
FIG. 4 is a view in longitudinal section of the embodiment of the invention shown in FIG. 3.
Figure 5:
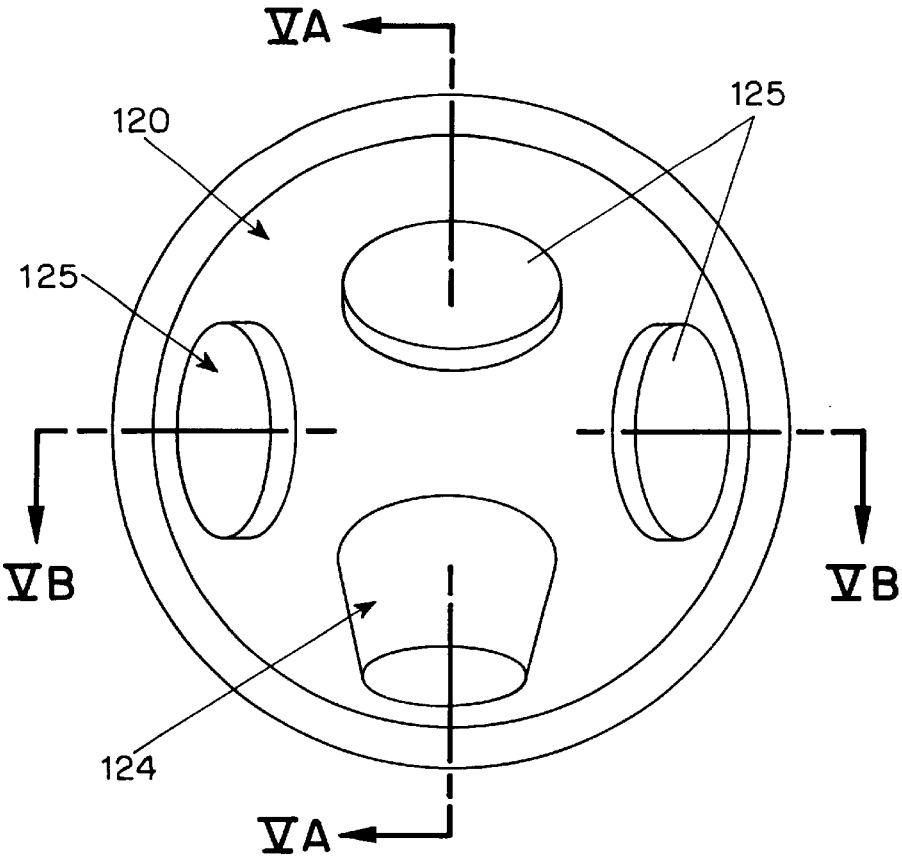
FIG. 5 is an end view showing an inlet head for the combined condenser and heat exchanger of FIGS. 3 and 4.
Figure 5A:
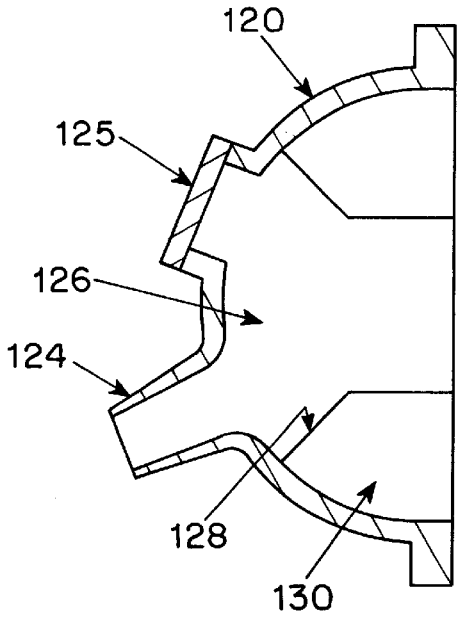
FIGS. 5A and 5B are cross-sectional views taken on the lines V-A—V-A and V-B—V-B, respectively, of FIG. 5 and looking in the direction of the arrows.
Figure 5B:
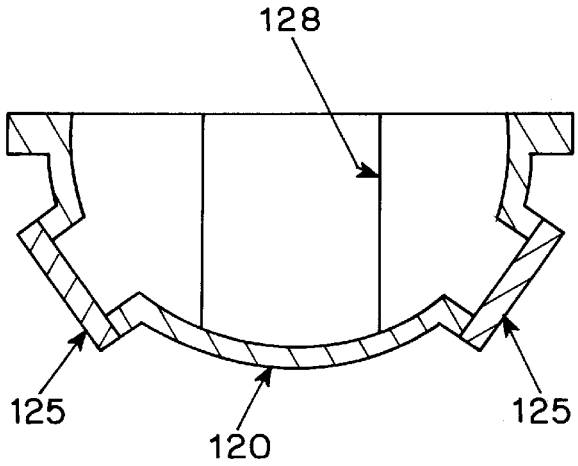
Figure 6:
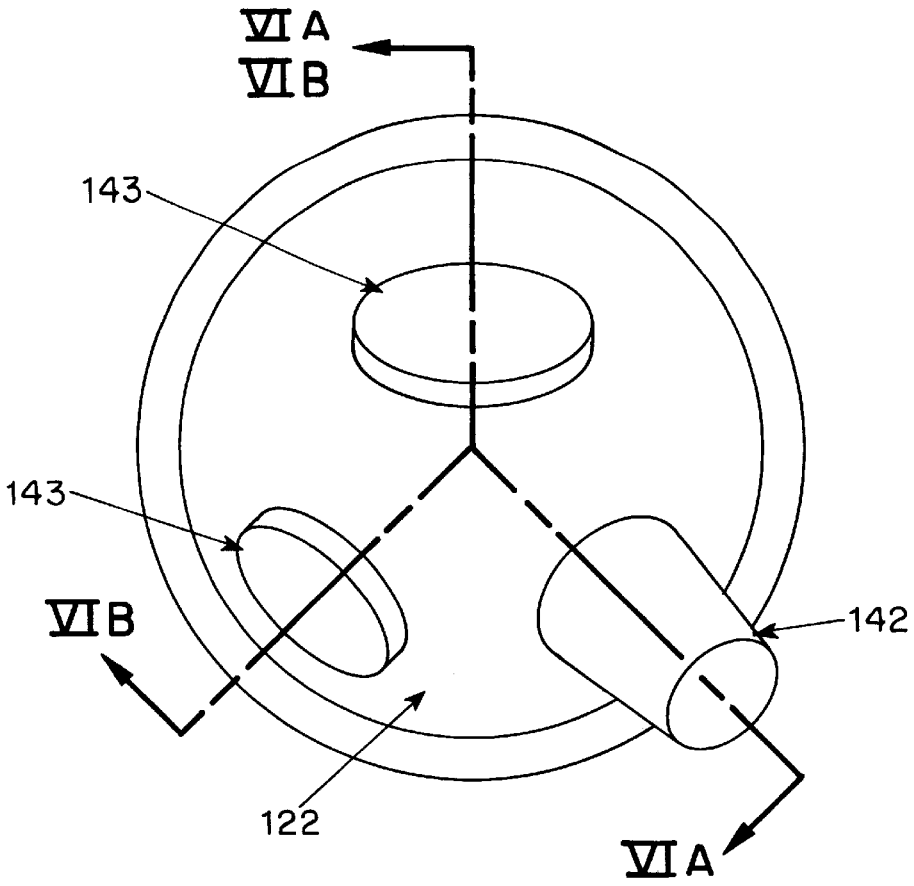
FIG. 6 is an end view showing an outlet head for the embodiment of FIGS. 3 and 4.
Figure 6A:
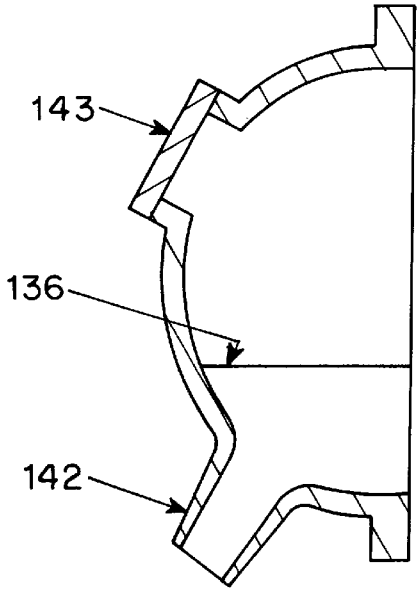
FIG. 6A is a cross-sectional view taken on the line VI-A—VI-A of FIG. 6 and looking in the direction of the arrows.
Figure 6B:
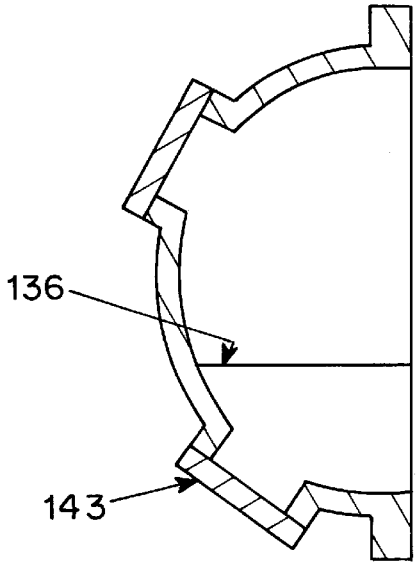
FIG. 6B is a cross-sectional view taken on the line VI-B—VI-B of FIG. 6 and looking in the direction of the arrows.
Figure 9:
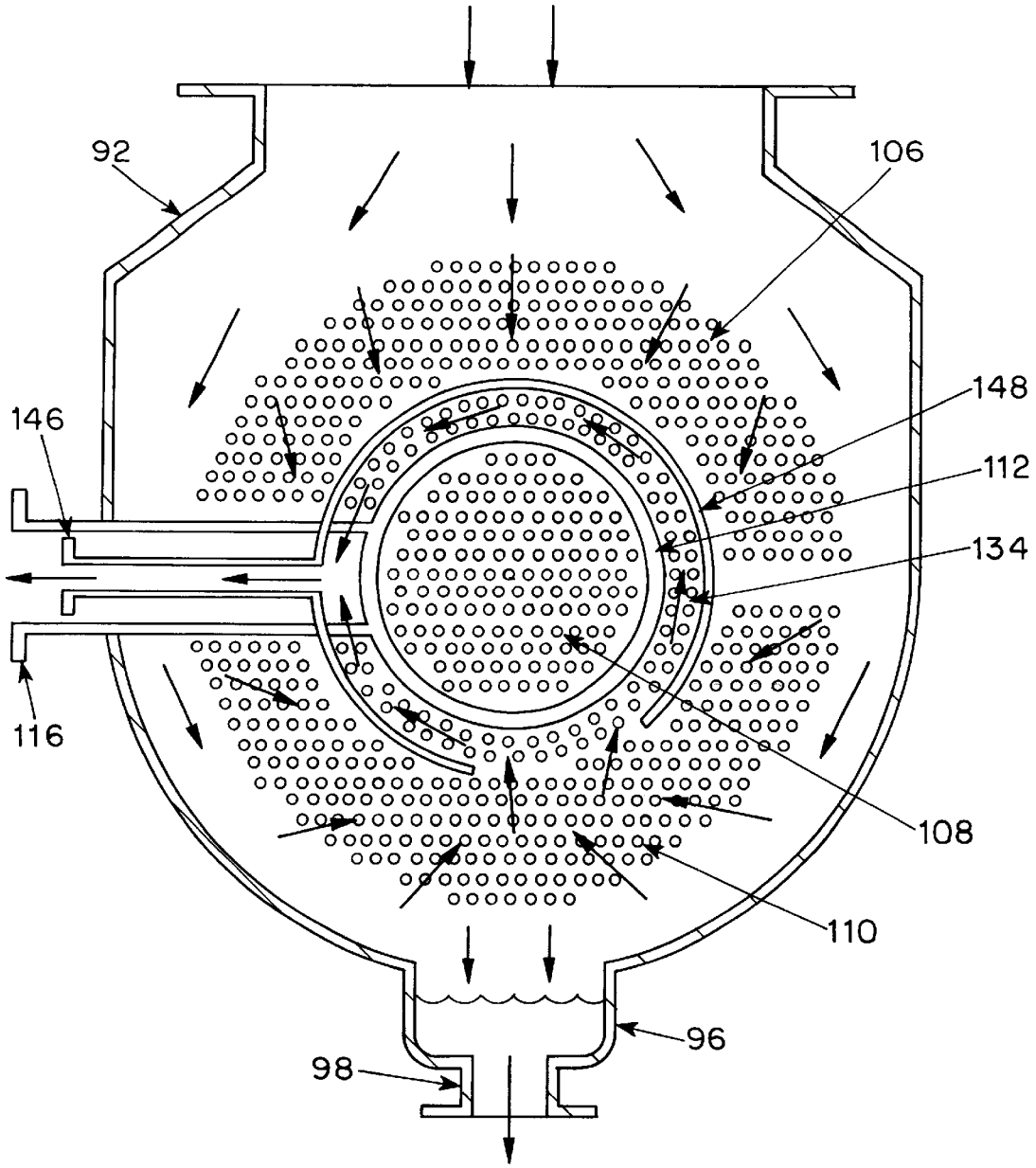
FIG. 9 is a cross-sectional view taken on the line IX—IX of FIG. 4 and looking in the direction of the arrows.

In order to protect the tubes 100 in the upper portion of the bundle 106 from direct impingement by steam received through the inlet opening 94, those tubes are covered by protective plates, tubes, or rods 144 as shown in FIG. 4. In addition, to remove air carried into the housing 12 with the steam through the inlet opening 94 an air take-off connection 146 extends through the side of the outer shell 92 as shown in FIGS. 3 and 9. The air is withdrawn through the connection 146 after it has been collected in an air baffle 148 which surrounds the circular inner portion 134 of the upper and lower bundles 106 and 110, respectively.

Figure 10:
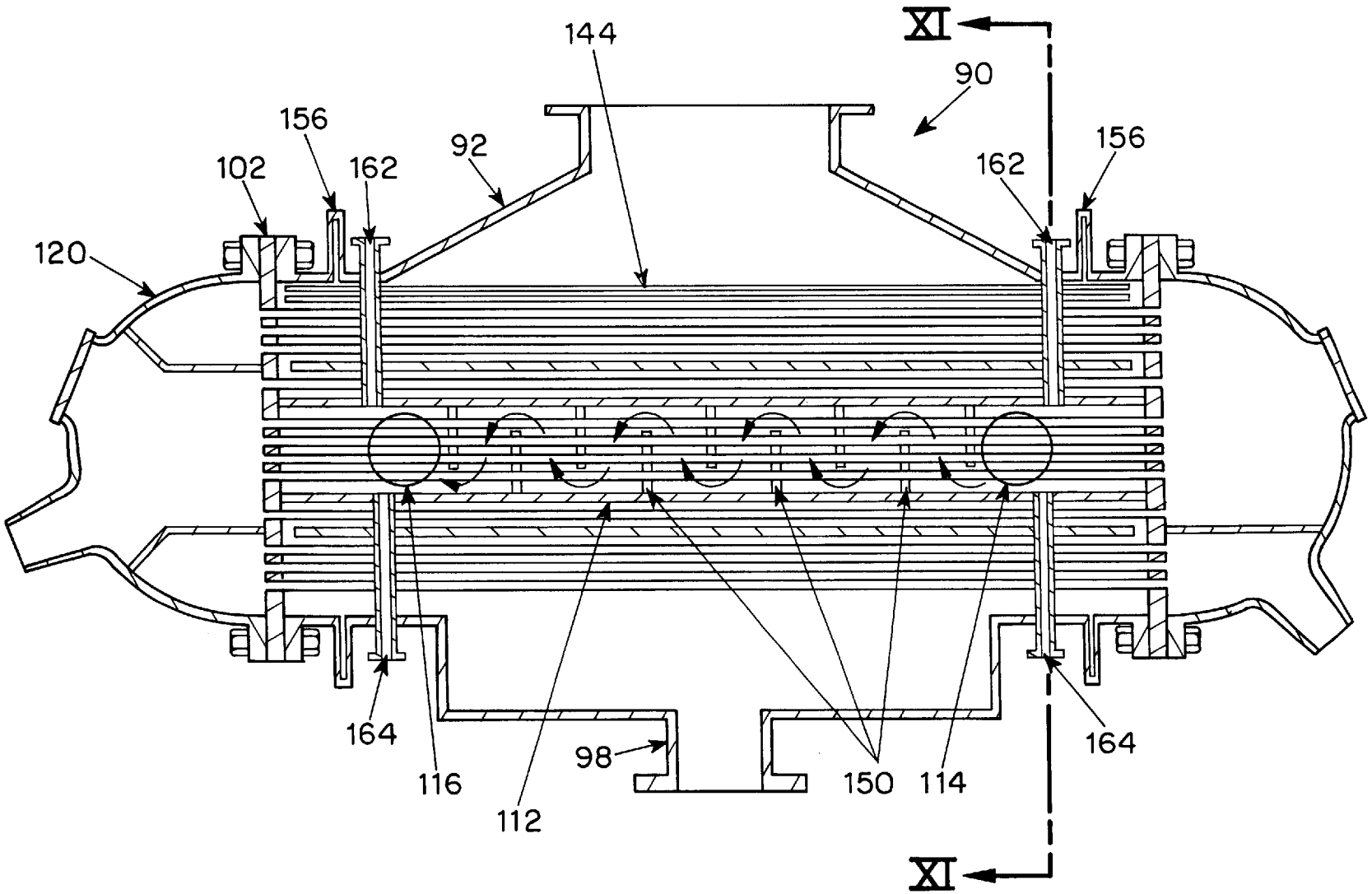
FIG. 10 is a longitudinal sectional view of the combined condenser/heat exchanger illustrating the hot medium flow path in the heat exchanger section.
Figure 11:
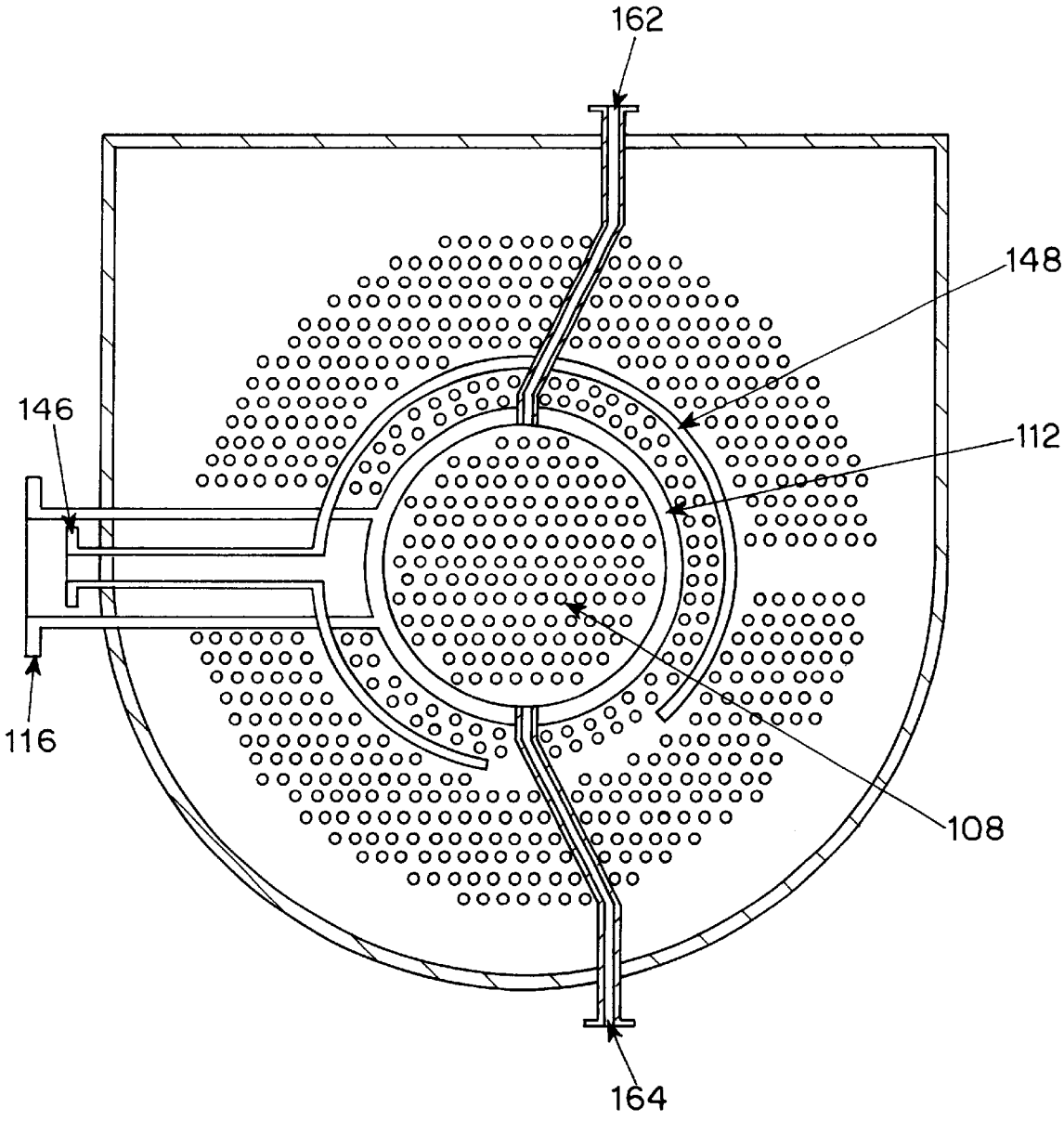
FIG. 11 is a cross-sectional view taken on the line XI—XI of FIG. 10 and looking in the direction of the arrows.
Figure 14:
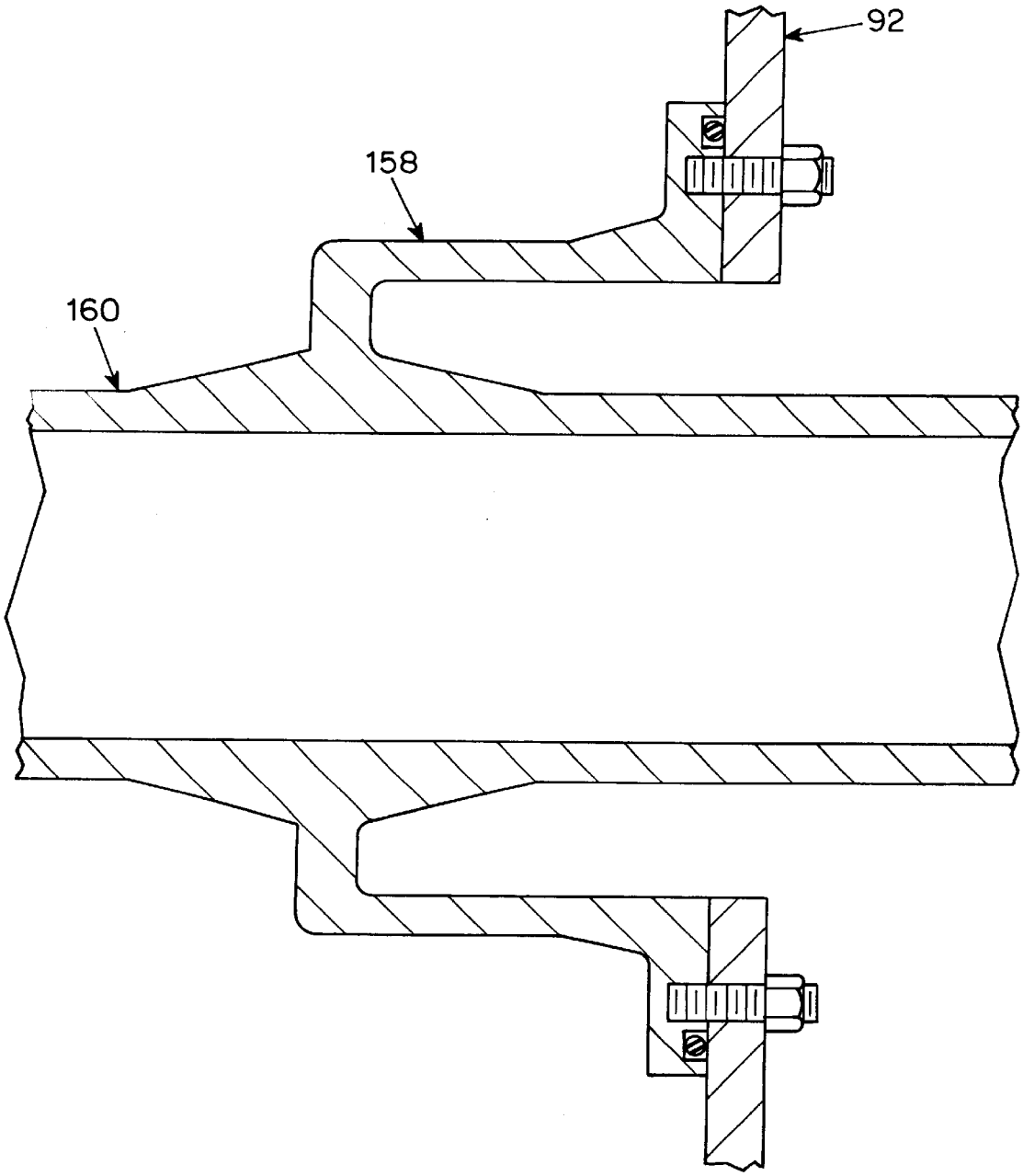
FIG. 14 is a fragmentary sectional view showing a thermal penetrater arrangement for a connection between a steam condenser shell and a heat exchanger shell.

Moreover, as shown in FIG. 10, internal heat exchanger baffles 150 provide a sinuous flow path around the central tube bundle 108 within the heat exchanger shell 112 for the hot liquid passing from the heat exchanger inlet 114 to the heat exchanger outlet 116. Furthermore, since the steam condenser shell 92 may be subjected to wide temperature variations in comparison with the temperature of the tubes 100 containing cooling liquid and the heat exchanger shell, expansion joints 156 are provided between the condenser shell 92 and the other components of the system. A typical expansion joint arrangement is shown in FIG. 14 in which a thermal expansion element 158 is connected on one side to the outer steam condenser shell 92 and on the other side to a connection 160 leading to the inner heat exchanger shell. The expansive joint has an L-shaped cross-section permitting relative expansion or contraction of the components to which it is connected with respect to each other.

In order to remove air from the inner shell 112, two vents 162 extend upwardly from the inner shell to the outside of the outer shell 92 as shown in FIG. 10. In addition, two drains 164 extend downwardly from the inner shell as shown in FIG. 10.

Figure 12:
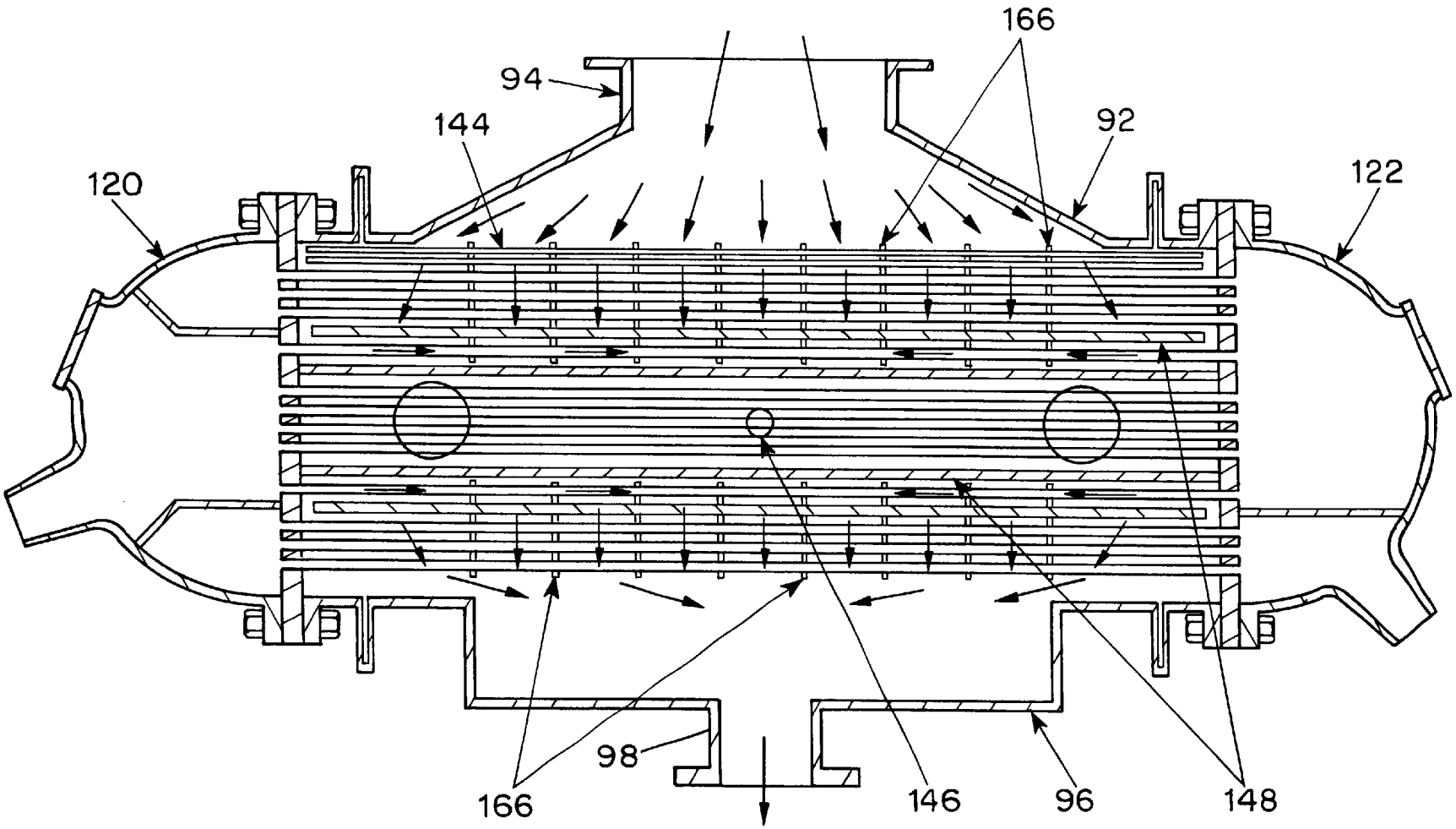
FIG. 12 is a longitudinal sectional view of the combined condenser/heat exchanger of FIGS. 3 and 4 showing the steam flow path in the condenser section.

FIG. 12 shows a series of spaced internal tube support plates 166 for maintaining the tubes 100 in the upper and lower bundles 106 and 110 in spaced relation and for guiding steam through the spaces between those tubes as shown by the arrows.

Figure 13:
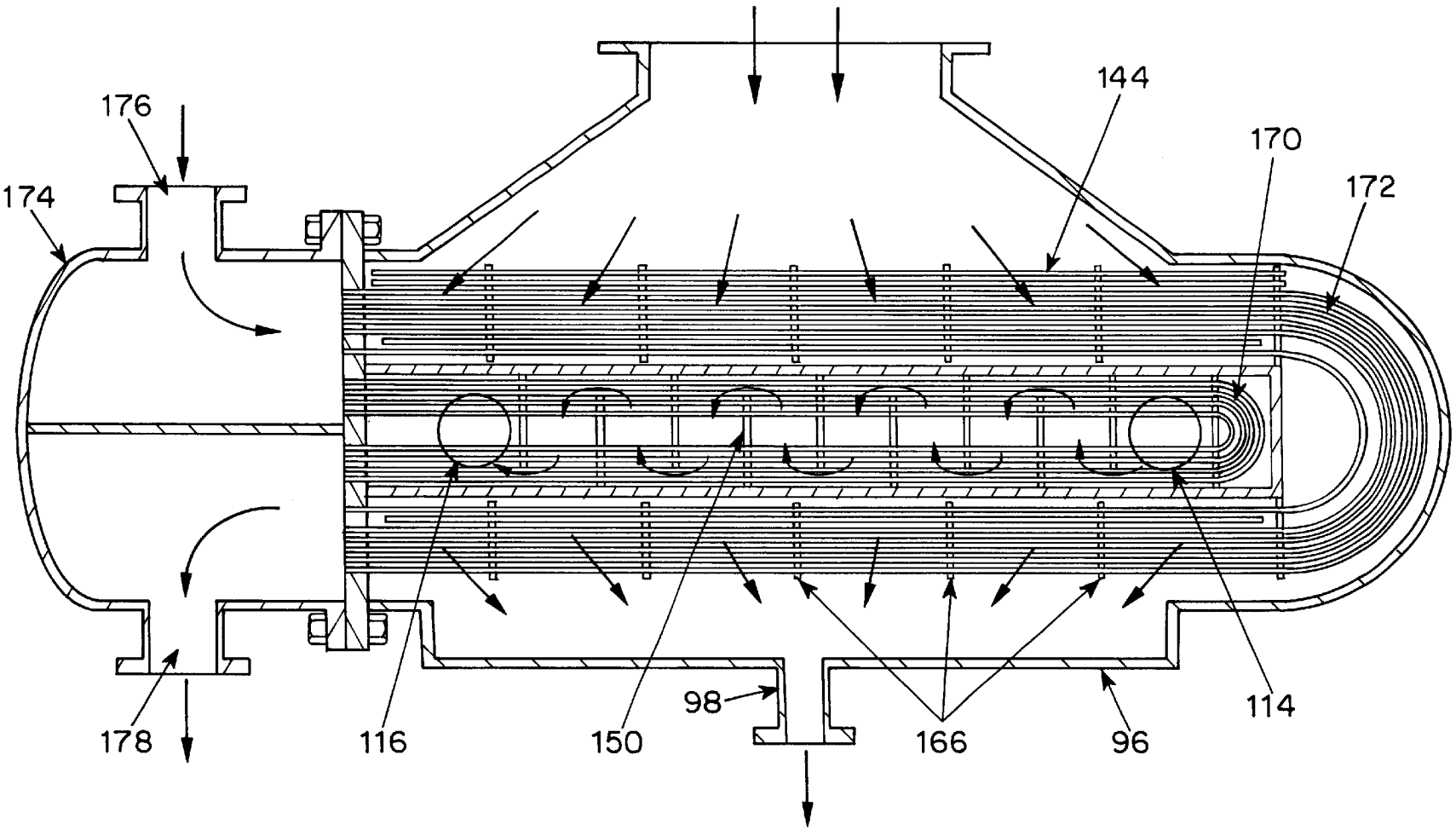
FIG. 13 is a longitudinal sectional view showing another representative embodiment of a combined condenser and heat exchanger according to the invention having U-shaped tubes.

In another embodiment of the invention, shown in FIG. 13, U-shaped tubes 170 are used in the heat exchanger and similar U-shaped tubes 172 are provided in the steam condenser. With this arrangement, an inlet-outlet head 174 is provided at one end of the combined unit having a coolant inlet 176 at the top and a coolant outlet 178 at the bottom. When U-shaped tubes are used for the heat exchanger, the material of the tubes need not be the same as that of the heat exchanger shell and the materials used for the heat exchanger and the condenser sections can be different.

With the foregoing arrangements in accordance with the invention, a steam condenser and a heat exchanger are combined within a single outer shell to provide a more efficient and economical structure.

Although the invention has been described herein with reference to specific embodiments, many modifications and variations therein will readily occur to those skilled in the art. Accordingly, all such variations and modifications are included within the intended scope of the invention.

I claim:

1. A combined steam condenser and heat exchanger comprising:

an outer steam condenser shell having a large diameter opening to receive steam and a small diameter steam condensate outlet;

an inner heat exchanger shell supported within the outer steam condenser shell and separated from the outer steam condenser shell to provide a space between the inner heat exchanger shell and the outer steam condenser shell surrounding the inner heat exchanger shell;

a first plurality of tubes extending through the inner heat exchanger shell;

a second plurality of tubes extending through the space between the inner heat exchanger shell and the outer steam condenser shell;

at least two tube support members for supporting both pluralities of tubes within the inner heat exchanger shell and in the space between the inner heat exchanger shell and the outer steam condenser shell, respectively;

an inlet head at one end of the outer steam condenser shell having a cooling liquid inlet for supplying cooling liquid to the tubes;

a cooling liquid outlet for conveying cooling liquid from the combined condenser and heat exchanger after it has passed through both pluralities of tubes;

a heat exchanger inlet for supplying a liquid to be cooled to a space between the first plurality of tubes within the inner heat exchanger shell in heat exchange relation to the cooling liquid in the tubes; and a heat exchanger outlet having approximately the same equivalent hydraulic diameter as the heat exchanger inlet for removing cooled liquid from the space between the first plurality of tubes within the inner heat exchanger shell.

2. A combined steam condenser and heat exchanger according to claim 1 wherein the cooling liquid outlet is at the opposite end of the tubes from the cooling liquid inlet and wherein the inlet head directs cooling liquid into the first plurality of tubes within the inner shell and including an outlet head which redirects cooling liquid from the first plurality of tubes into a first portion of the second plurality of tubes; and wherein the inlet head has a chamber for directing cooling liquid received from the first portion of the second plurality of tubes through a second portion of the second plurality of tubes to an outlet in the outlet head.

3. A combined steam condenser and heat exchanger according to claim 1 wherein the tubes in the first plurality are U-shaped tubes communicating at one end with an inlet chamber in the inlet head and at the other end with an outlet chamber in the inlet head and wherein the tubes in the second plurality are U-shaped tubes communicating at one end with the inlet chamber and at the other end with the outlet chamber in the inlet outlet head.

4. A combined steam condenser and heat exchanger according to claim 1 including a plurality of transverse baffles within the inner shell section to direct liquid to be cooled supplied to the space outside the tubes within the inner shell in a sinuous path from the heat exchanger inlet to the heat exchanger outlet.

5. A combined steam condenser and heat exchanger according to claim 1 including an expansion joint between the outer shell and a tube sheet.

6. A combined steam condenser and heat exchanger according to claim 5 wherein the expansion joint comprises an L-shaped connection between the outer shell and the tube sheet.

7. A combined steam condenser heat exchanger according to claim 1 including an air baffle in the space above the inner shell for collecting air introduced with steam into the outer shell and an air outlet communicating with a region beneath the air baffle for removing air from the outer shell.

8. A combined steam condenser and heat exchanger according to claim 1 including a vent extending from the inner shell upwardly through the top of the outer shell.

9. A combined steam condenser and heat exchanger according to claim 1 including a drain extending from the inner shell downwardly through the bottom of the outer shell.

* * * * *